US009297229B2

(12) United States Patent
Rytlewski

(10) Patent No.: US 9,297,229 B2
(45) Date of Patent: Mar. 29, 2016

(54) HARD BOTTOM CEMENT SEAL FOR IMPROVED WELL CONTROL

(75) Inventor: Gary L. Rytlewski, League City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 249 days.

(21) Appl. No.: 13/812,685

(22) PCT Filed: Jul. 27, 2011

(86) PCT No.: PCT/US2011/045476

§ 371 (c)(1), (2), (4) Date: Apr. 16, 2013

(87) PCT Pub. No.: WO2012/015879

PCT Pub. Date: Feb. 2, 2012

(65) Prior Publication Data

US 2013/0220609 A1 Aug. 29, 2013

Related U.S. Application Data

(60) Provisional application No. 61/400,442, filed on Jul. 28, 2010.

(51) Int. Cl.

| | |
|---|---|
| ***E21B 33/14*** | (2006.01) |
| ***E21B 33/12*** | (2006.01) |
| ***E21B 21/10*** | (2006.01) |
| ***E21B 33/16*** | (2006.01) |

(52) U.S. Cl.

CPC ..... *E21B 33/1204* (2013.01); *E21B 21/10* (2013.01); *E21B 33/14* (2013.01); *E21B 33/143* (2013.01); *E21B 33/16* (2013.01)

(58) Field of Classification Search

CPC ..... E21B 17/04; E21B 21/10

See application file for complete search history.

(56) References Cited

U.S. PATENT DOCUMENTS

| | | | | |
|---|---|---|---|---|
| 2,254,246 | A | 9/1941 | Scaramucci | |
| 3,159,219 | A | 12/1964 | Scott | |
| 3,734,188 | A * | 5/1973 | Root et al. | 166/292 |
| 3,901,321 | A * | 8/1975 | Mott | 166/373 |
| 4,532,995 | A * | 8/1985 | Kaufman | 166/327 |
| 4,589,495 | A * | 5/1986 | Langer et al. | 166/383 |
| 4,664,192 | A | 5/1987 | Hogarth | |
| 4,774,102 | A | 9/1988 | Kiefer et al. | |
| 4,848,459 | A | 7/1989 | Blackwell et al. | |
| 5,277,255 | A | 1/1994 | Bell | |
| 5,890,537 | A | 4/1999 | Lavaure et al. | |
| 6,302,205 | B1 * | 10/2001 | Ryll | 166/250.12 |
| 6,561,270 | B1 * | 5/2003 | Budde | 166/153 |
| 7,857,052 | B2 * | 12/2010 | Giroux et al. | 166/289 |
| 2006/0048972 | A1 * | 3/2006 | Odell et al. | 175/57 |
| 2008/0087415 | A1 | 4/2008 | McGuire et al. | |

* cited by examiner

*Primary Examiner* — Giovanna C Wright

(57) ABSTRACT

Methods include introducing a casing into a wellbore penetrating a subterranean formation, the casing forming an annulus with the wellbore surface, where the casing is subject to a first pressure value at a distal end and a second pressure value at a proximal region within the casing, and where a shoe is positioned at the distal end of the casing. Then, placing a sealable valve within the proximal region of the casing, injecting a first cement composition into the casing, through the sealable valve and shoe, and into the annulus, and the placing a second cement composition in a medial region of the tubular formed between the distal end and the proximal region. Afterward, the sealable valve is closed.

10 Claims, 1 Drawing Sheet

HARD BOTTOM CEMENT SEAL FOR IMPROVED WELL CONTROL

BACKGROUND

The statements made herein merely provide information related to the present disclosure and may not constitute prior art, and may describe some embodiments illustrating the invention.

It is known that in drilling some wells, sections of casing are run down a borehole, often with a float shoe at the lower end which is equipped with a double valve enabling the casing to fill with drilling mud both while the casing is moving down and also while it is stationary. Within the casing is a baffle collar which defines a socket for a latching dart carried by a plug. The plug and dart are driven down to the collar, when the pumping of cement into the casing has been completed, by a launching dart which also closes the passageway through the plug. U.S. Pat. No. 4,664,192.

Also known are well liner running shoes which include ports for discharging cement into the well annulus between the liner and the wellbore wall, a check valve to prevent reverse flow of fluid up through the interior of the liner and the workstring, receiver means for receiving a cement plug or "dart" and receiver means for receiving a running tool which may be disconnected from the shoe after the liner has been set in its predetermined position. U.S. Pat. No. 5,277,255.

SUMMARY

In some first embodiments, an apparatus includes a tubular subject to a first pressure value at a distal end and a second pressure value at a proximal region within the tubular, a shoe disposed within the distal end of the tubular, a sealable valve disposed within the proximal region within the tubular, and a cement composition contained within a medial region of the tubular formed between the distal end and the proximal region. In some cases the tubular is a casing disposed in a wellbore penetrating a subterranean formation.

The surface of the subterranean formation may be located undersea, or on land. Also, the first pressure value may be greater than or equal to the second pressure value, and vice versa. The sealable valve may be a ball valve, a sleeve valve, flapper valve, butterfly valve, multiple flapper valves, multiple checks valves, or any other suitable valve arrangement known to those with skill in the art. Alternatively, in some cases the apparatus does not include a check valve in the shoe.

In some other embodiments, methods are provided which include introducing a casing into a wellbore penetrating a subterranean formation, the casing forming an annulus with the wellbore surface, where the casing is subject to a first pressure value at a distal end and a second pressure value at a proximal region within the casing, and where a shoe is positioned at the distal end of the casing. Then, placing a sealable valve within the proximal region of the casing, injecting a first cement composition into the casing, through the sealable valve and shoe, and into the annulus, and the placing a second cement composition in a medial region of the tubular formed between the distal end and the proximal region. Afterward, the sealable valve is closed.

For these embodiments, in some cases the tubular is a casing disposed in a wellbore penetrating a subterranean formation. The surface of the subterranean formation may be located undersea, or on land. Also, the first pressure value may be greater than or equal to the second pressure value, and vice versa. The sealable valve may be a ball valve, a sleeve valve, flapper valve, butterfly valve, multiple flapper valves, multiple checks valves, or any other suitable valve arrangement known to those with skill in the art. Alternatively, in some cases the apparatus does not include a check valve in the shoe.

In yet some other embodiments, methods are provided which include introducing a tubular into an open hole wellbore penetrating a subterranean formation, the tubular forming an annulus with the open hole wellbore surface, where the tubular is subject to a first pressure value at a distal end and a second pressure value at a proximal region within the tubular, and where a shoe is positioned at the distal end of the tubular; placing a sealable valve within the proximal region of the tubular; injecting a cement composition into the casing, through the sealable valve and shoe, and into the annulus; and, closing the sealable valve.

Again, in some cases the tubular is a casing disposed in a wellbore penetrating a subterranean formation. The surface of the subterranean formation may be located undersea, or on land. Also, the first pressure value may be greater than or equal to the second pressure value, and vice versa. The sealable valve may be a ball valve, a sleeve valve, flapper valve, butterfly valve, multiple flapper valves, multiple checks valves, or any other suitable valve arrangement known to those with skill in the art. Alternatively, in some cases the apparatus does not include a check valve in the shoe.

BRIEF DESCRIPTION OF THE DRAWINGS

The manner in which the objectives of some embodiments and other desirable characteristics may be obtained is explained in the following description and attached drawings in which.

DESCRIPTION

Figure 1:
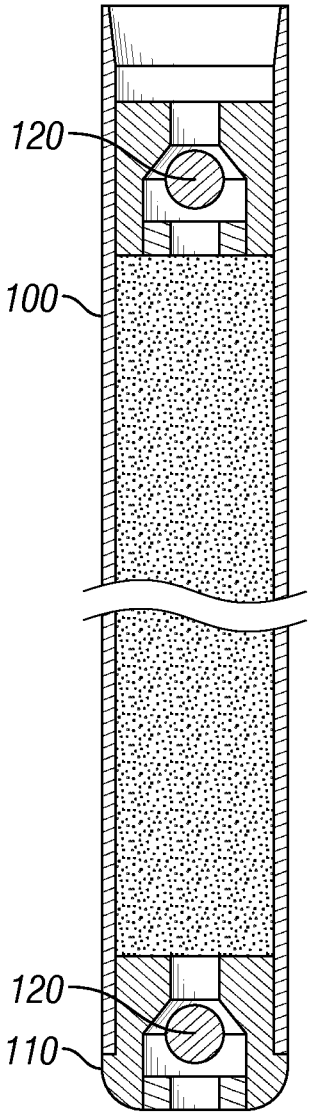
FIG. 1 (Prior Art)
FIG. 1 illustrates an apparatus having a shoe with a check valve at the very bottom of the string, a casing joint, and a float collar with a check valve.

At the outset, it should be noted that in the development of any such actual embodiment, numerous implementation—specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary of the invention and this detailed description, each numerical value should be read once as modified by the term "about" (unless already expressly so modified), and then read again as not so modified unless otherwise indicated in context.

Some embodiments relate to methods of cementing, prior to perforation, a wellbore with casing disposed therein. Some embodiments of the invention incorporate the concept of a "hard bottom" into the production casing string. The term "hard bottom" means a sealing component with high pressure integrity, and not necessarily easy to drill out. The pressure integrity is obtained by adding valves to the bottom of the production casing or production liner. These valves allow the casing to be cemented in the well but after cementing, seal the bottom of the production casing mechanically and with high pressure integrity. The valves (not cement) keeps the formation fluids from coming into the well bore through the shoe. The cement trapped between shoe and ball valve in the illustration above can now be a redundant seal.

In some instances, the concept is to add a reliable barrier. In current practice, if all proceeds as planned, the cement between shoe and float collar provides a good barrier. However, in some embodiments, a technique to incorporate an additional barrier is used as a contingency in case all does not proceed as planned in the operation, such as the instance where cement is over displaced. This can be a critical well control issue and adding a sealable valve, such as a ball valve, further ensures a reliable barrier.

Some embodiments disclosed are casing or liner cementing methods including positioning lower and upper wiper plugs having elastomer cups that are inwardly compressed in an open-bottomed tubular basket near the top of the liner, the basket having an outer diameter that is less than the inner diameter of the liner to permit cement to flow therebetween, the basket having a tubular body extending upwardly therefrom; providing a push rod in the body that can move longitudinally thereof and which has a lower end engaging the upper plug, pumping a first piston or dart down into engagement with the upper end of the rod and then applying pressure to the dart to force the rod downward a selected distance to expel the lower plug from the basket and out into the liner where said cups expand to engage the liner walls and provide a separation between the lower end of a column of cement and the drilling fluids, pumping a certain volume of cement slurry into the liner with said lower plug moving downward at the lower end of the cement, pumping a second piston or dart down into engagement with the first dart, and then applying pressure to force both of the darts and the rod further downward another selected distance to expel the upper plug from the basket and out into the liner where its cups expand to provide a separation between the upper end of the column of cement and the displacing fluids. The cement and plugs then are pumped on down the liner, and when the lower plug seats against a float collar or float shoe, a passage is opened through the plug to enable the cement to flow into the annulus. When the upper wiper plug engages the lower one, the displacement is complete. The basket and body assembly then is retrieved to the surface so that the inside of the liner is unobstructed. Apparatus in accordance with this includes a tubular body having a cylindrical, open-bottomed basket mounted on its lower end. Lower and upper elastomeric wiper plugs are force-fitted into the basket, which temporarily reduces their respective outer diameters. A push rod is mounted for longitudinal movement in the body with its lower end in engagement with the upper plug. The upper end of such rod is adapted to be engaged by a first dart or piston that is pumped down the running string and into the body in order to drive the rod and both wiper plugs downward until the lower plug is expelled from the basket. Upon expulsion, the plug expands radially outward to its relaxed diameter where the outer edges of its cups engage the inner walls of the liner. This plug then moves ahead of a column of cement which is being pumped down the running string and out of lateral ports in the body above the rod. From there the cement flows through the annular space between the basket and the inner wall of the liner. At the appropriate time a second dart or piston is pumped down into the body and engages the first dart. Fluid pressure then is applied to drive the two darts and the rod further downward until the upper wiper plug also is expelled from the basket and launched into the liner at the upper end of the column of cement. This plug expands like the first one to provide a moving seal that prevents contamination of the upper end of the cement column. When the cementing is complete, means are provided to enable the body, the basket, the drive rod and the darts to be retrieved to the surface. U.S. Pat. No. 5,890,537.

In general, there are three possible locations where formation fluid can enter the well bore in a cemented casing prior to perforating; at the shoe, at the top of the liner or casing and through a ruptured casing. The leak at the shoe is thought to be the most likely and some embodiments address improvements to the pressure integrity of the completion in the shoe area.

As discussed, at least in part above, typical hardware at the end of a casing string or liner allows cement to be pumped down the casing inner diameter and back up the wellbore through the annulus formed between the casing and the wellbore. This hardware arrangement typically has check valves which keeps the cement from re-entering (u-tubing) back into the casing at the end of the cementing operation, when pump pressure is removed or reduced. This equipment is typically designed and built to be easily drillable with plastic and aluminum interior parts that are often cemented or held with epoxy. Components of this type arrangement are illustrated in FIG. 1.

As shown in FIG. 1, the casing shoe 110 has a check valve and is at the very bottom of the string. Next, a casing joint is commonly used followed by the float collar 100. The float collar may also have a check valve 120. Also, as shown in FIG. 1, a check valve in the shoe and a check valve in a float collar re spaced typically 20-40 ft apart. After the cementing operation, the 20-40 ft of cement can become the barrier and is pressure testable when the cement is cured.

In one embodiment, during the cementing operation, a casing wiper dart is pumped on top of the last cement going in the well and a pressure spike indicates the wiper has hit bottom or "bumps". Below the wiper is expected to be a good column of cement between the shoe and float collar. This cement column is expected to be the long term barrier to keep formation fluids from entering the well bore from the bottom. A primary purpose for these check valves is to keep cement from u-tubing, but these check valves can also provide a barrier to formation fluid entering the well bore at the shoe.

Cementing a liner or a casing string back to the wellhead is typically done the same way in any onshore, or offshore formation, notwithstanding water depth. A casing hanger or liner hanger is on top of the casing string and attaches to a workstring (in most cases, the available drill pipe). The workstring inner diameter (ID) is smaller than the casing so there are actually two cement wiper darts used. The casing wiper is commonly pre-assembled below the liner hanger and has a hollow ID. The smaller workstring wiper dart is launched from the surface at the end of the cement. This smaller dart wipes the workstring ID and lands inside the casing wiper dart and seals. Pressuring up, shears some screws and releases the casing wiper dart. Systems have wiper darts before and after the cement column.

If the operation is performed and results according to plan, the wipers are effective and bump at the end on cement column, and subsequently, a non contaminated volume of cement cures in the casing joint between shoe and float collar. But there are several things that can compromise the long term cement seal at the bottom of the casing. Some of the things that can go wrong are:

1. Wipers plugs do not "bump"
2. Wipers are damage and allow contamination

3. Contaminates on ID of drill string or casing are swept off the surface by wiper dart and contaminates last feet of cement
4. Wiper is damaged and allows over displacement and a wet shoe
5. Cement does not cure sufficiently before a pressure test
6. Weak cement
7. Check valves leak and contaminated cement u-tubes back into bottom of casing
8. Contaminated cement does not cure, does not develop sufficient strength or has channels In some embodiments of the invention, a ball valve is incorporated where the float collar is installed. The ball is closed when all the cement or nearly all of the cement is pumped past ball valve. The ball valve will allow an immediate pressure test (both positive and negative) up to full casing rating regardless of the condition of the cement. Additionally, reliance on cement to provide a long term seal at the bottom of the production casing string is avoided.

Additionally, if the ball valve or valves are used without check valves, the casing will "auto fill" while running in the hole. This eliminates the need to top fill. If top filling is not done frequently, well control issues could arise.

Figure 2:
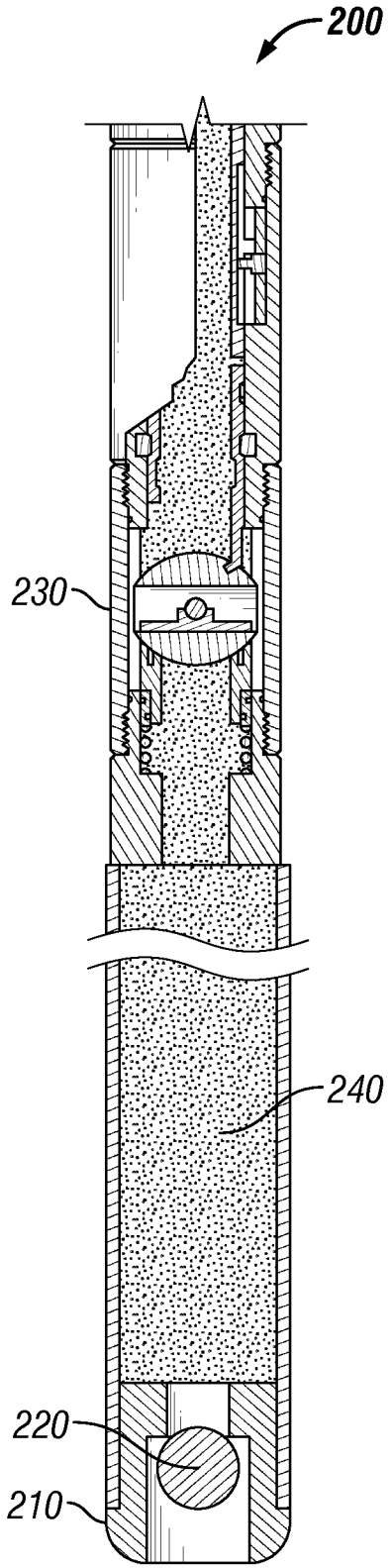
FIG. 2 illustrates an apparatus having a shoe with a check valve at the very bottom of the string, a casing joint with cement composed therein, a sealable valve thereabove, and a float collar with a check valve.

Referring now to FIG. 2, which shows a casing show and float collar 200, in some embodiments, when the ball valve 220 is closed, it can create a "hard bottom" which may be more difficult to drill. There are two common cases when drilling out the bottom is desired. The first case is if the production casing did not get close to the proper depth and is cemented high in the hole. The bottom would then be drilled out and a smaller liner would be run through this casing. The second case is a planned temporary bottom where the well would be produced for a period of time and then the well bore lengthened to produce from a deeper zone. However, a drillable shoe on the production casing string is not perceived as bringing much value in some instances. The drillable shoe on the intermediate casing and everything larger is optimum and is just repeated on the production casing. If a well with a hard shoe does need to be deepened, the well can be drilled by side tracking. The arrangement in FIG. 2 also includes a sealable valve 230, such as a flapper valve, and the cement 240 located in a medial region of the tubular formed between the distal end and the proximal region.

Some methods which may be used to close the ball valve proximate the shoe include, but are not limited to, bumping of the wiper dart, a ball dropped before the cement wiper dart, a temperature profile based on the cooling effect of pumping cement and then warming back to or near reservoir temperature, RF tags in cement passing through ball valve, RF signal in wiper dart or other device pumped or drop in well at end of the cement column but does not pass through valve, pressure pulse signal, electromagnetic signal, acoustic signal, seismic signal, or the like.

Alternative to the ball valves described above, the functionality of the ball valve could be duplicated with other sealable valves such as a sleeve valve, multiple flapper valves (facing opposite directions) held open during cementing, multiple checks (facing opposite directions) held open during cementing, and the like.

The foregoing disclosure and description of the invention is illustrative and explanatory thereof and it can be readily appreciated by those skilled in the art that various changes in the size, shape and materials, as well as in the details of the illustrated construction or combinations of the elements described herein can be made without departing from the spirit of the invention. None of the description in the present application should be read as implying that any particular element, step, or function is an essential element which must be included in the claim scope: THE SCOPE OF PATENTED SUBJECT MATTER DEFINED ONLY BY THE ALLOWED CLAIMS. Moreover, none of these claims are intended to invoke paragraph six of 35 USC section 112 unless the exact words "means for" are followed by a participle. The claims as filed are intended to be as comprehensive as possible, and NO subject matter is intentionally relinquished, dedicated, or abandoned.

What is claimed is:

1. An apparatus, comprising:
a. a tubular subject to a first pressure value at a distal end and a second pressure value at a proximal region within the tubular;
b. a shoe disposed within the distal end of the tubular, wherein the shoe comprises a ball valve;
c. a rotating ball valve disposed within the proximal region within the tubular; and,
d. a cement composition contained within a medial region of the tubular formed between the distal end and the proximal region.

2. The apparatus of claim 1 wherein the tubular is a casing disposed in a wellbore penetrating a subterranean formation.

3. The apparatus of claim 2 wherein the surface of the subterranean formation is positioned undersea.

4. The apparatus of claim 1 wherein the first pressure value is greater than or equal to the second pressure value.

5. A method comprising:
a. introducing a casing into a wellbore penetrating a subterranean formation, the casing forming an annulus with the wellbore surface, wherein the casing is subject to a first pressure value at a distal end and a second pressure value at a proximal region within the casing, and wherein a shoe is positioned at the distal end of the casing, the shoe comprising a ball valve;
b. placing a rotating ball valve within the proximal region of the casing;
c. injecting a first cement composition into the casing, through the rotating ball valve and shoe, and into the annulus;
d. placing a second cement composition in a medial region of the tubular formed between the distal end and the proximal region; and
e. closing the rotating ball valve.

6. The method of claim 5 wherein the surface of the subterranean formation is positioned undersea.

7. The method of claim 5 wherein the first pressure value is greater than or equal to the second pressure value.

8. The method of claim 5 further comprising applying high pressure in the casing to test the pressure integrity of casing installation prior to curing of the first cement composition and/or the second cement composition.

9. A method comprising:
a. introducing a tubular into an open hole wellbore penetrating a subterranean formation, the tubular forming an annulus with the open hole wellbore surface, wherein the tubular is subject to a first pressure value at a distal end and a second pressure value at a proximal region within the tubular, and wherein a shoe is positioned at the distal end of the tubular, the shoe comprising a ball valve;
b. placing a rotating ball valve within the proximal region of the tubular;
c. injecting a cement composition into the casing, through the rotating ball valve and shoe, and into the annulus; and,
d. closing the rotating ball valve.

10. The method of claim 9 wherein the first pressure value is greater than or equal to the second pressure value.

* * * * *